US007307588B2

(12) United States Patent
Tseng

(10) Patent No.: US 7,307,588 B2
(45) Date of Patent: Dec. 11, 2007

(54) ULTRA WIDE BANDWIDTH PLANAR ANTENNA

(75) Inventor: Kuo-Hua Tseng, Kaohsiung Hsien (TW)

(73) Assignee: Universal Scientific Industrial Co., Ltd., Nan-Tou Hsien (TW)

( * ) Notice: Subject to any disclaimer, the term of this patent is extended or adjusted under 35 U.S.C. 154(b) by 36 days.

(21) Appl. No.: 11/281,639

(22) Filed: Nov. 16, 2005

(65) Prior Publication Data

US 2007/0109195 A1 May 17, 2007

(51) Int. Cl.
*H01Q 1/38* (2006.01)

(52) U.S. Cl. ..... 343/700 MS; 343/829; 343/830; 343/725; 343/729

(58) Field of Classification Search ..... 343/700 MS, 343/767, 770, 793, 795, 810, 865, 846, 859
See application file for complete search history.

(56) References Cited

U.S. PATENT DOCUMENTS 4,775,866 A * 10/1988 Shibata et al. ..... 343/700 MS
6,590,545 B2 * 7/2003 McCorkle ..... 343/830
6,642,903 B2 * 11/2003 Schantz ..... 343/795
6,768,461 B2 * 7/2004 Huebner et al. ..... 343/700 MS
7,061,442 B1 * 6/2006 Tang et al. ..... 343/767
7,106,258 B2 * 9/2006 Kuramoto ..... 343/700 MS
7,158,089 B2 * 1/2007 Mohammadian et al. ... 343/795

* cited by examiner

*Primary Examiner*—Douglas W. Owens
*Assistant Examiner*—Chuc Tran
(74) *Attorney, Agent, or Firm*—Ladas & Parry, LLP

(57) ABSTRACT

A planar antenna, which is operable within the ultra wide bandwidth, includes a dielectric substrate, an elliptical radiating element, a feeding element, and a grounding element. The dielectric substrate has opposite first and second surfaces. The elliptical radiating element is formed on the first surface of the dielectric substrate, and has major and minor axes. The ratio of the major axis to the minor axis is between 1.25 and 1.7. The feeding element is formed on the first surface of the dielectric substrate, and is coupled to the radiating element. The grounding element is formed on the second surface of the dielectric substrate, and is coupled to the feeding element.

21 Claims, 9 Drawing Sheets

ULTRA WIDE BANDWIDTH PLANAR ANTENNA

BACKGROUND OF THE INVENTION

1. Field of the Invention

This invention relates to a planar antenna, more particularly to an ultra wide bandwidth planar antenna.

2. Description of the Related Art

FIG. 1 illustrates a conventional planar antenna 1 that operates within the ultra wide bandwidth, i.e., between 3.1 GHz and 10.6 GHz. The conventional planar antenna 3 includes a radiating element 10, a feeding element 11, and a grounding element 20. The radiating element 10 is generally elliptical, and has major and minor axes (a, b) that are respectively 11.21 millimeters and 10.125 millimeters in length. The grounding element 20 is generally rectangular in shape, and has a pair of long sides (c), each of which has a length of 30 millimeters, and a pair of short sides (d), each of which has a length of 10 millimeters.

The aforementioned conventional planar antenna 1 is disadvantageous in that, since each long side (c) of the grounding element 20 is longer than the minor axis (b) of the radiating element 10, the size of the conventional planar antenna 1 is relatively large. Furthermore, as illustrated in FIGS. 2 and 3, when operated from 9 GHz to 11 GHz, the conventional planar antenna 1 has radiation patterns that are not omni-directional.

SUMMARY OF THE INVENTION

Therefore, the object of the present invention is to provide an ultra wide bandwidth planar antenna that is relatively small in size, and that has omni-directional radiation patterns when operated above 8 GHz.

According to the present invention, a planar antenna, which is operable within the ultra wide bandwidth, comprises a dielectric substrate, an elliptical radiating element, a feeding element, and a grounding element. The dielectric substrate has opposite first and second surfaces. The elliptical radiating element is formed on the first surface of the dielectric substrate, and has major and minor axes. The ratio of the major axis to the minor axis is between 1.25 and 1.7. The feeding element is formed on the first surface of the dielectric substrate, and is coupled to the radiating element. The grounding element is formed on the second surface of the dielectric substrate, and is coupled to the feeding element.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
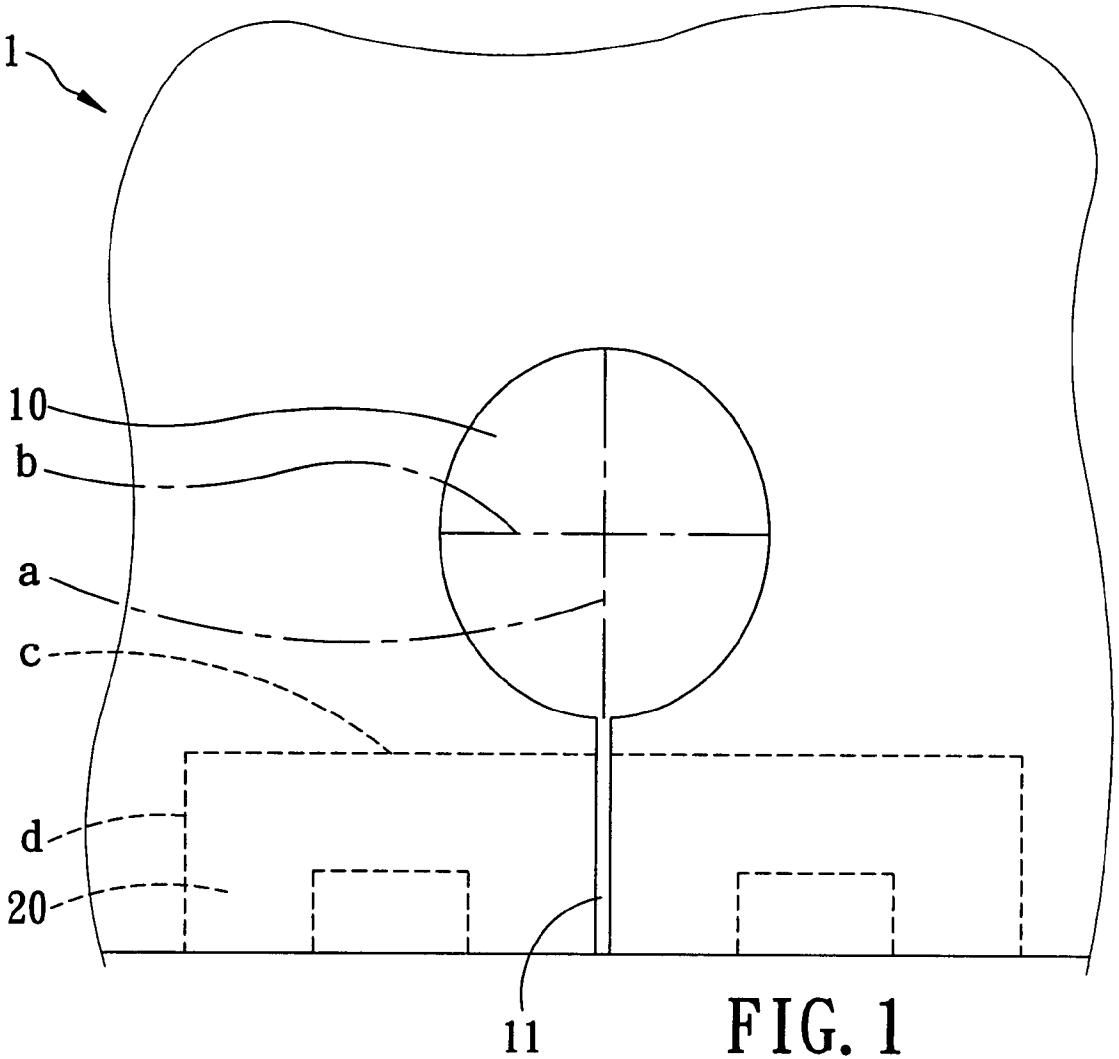
FIG. 1 PRIOR ART
FIG. 1 is a schematic view of a conventional planar antenna.
Figure 2:
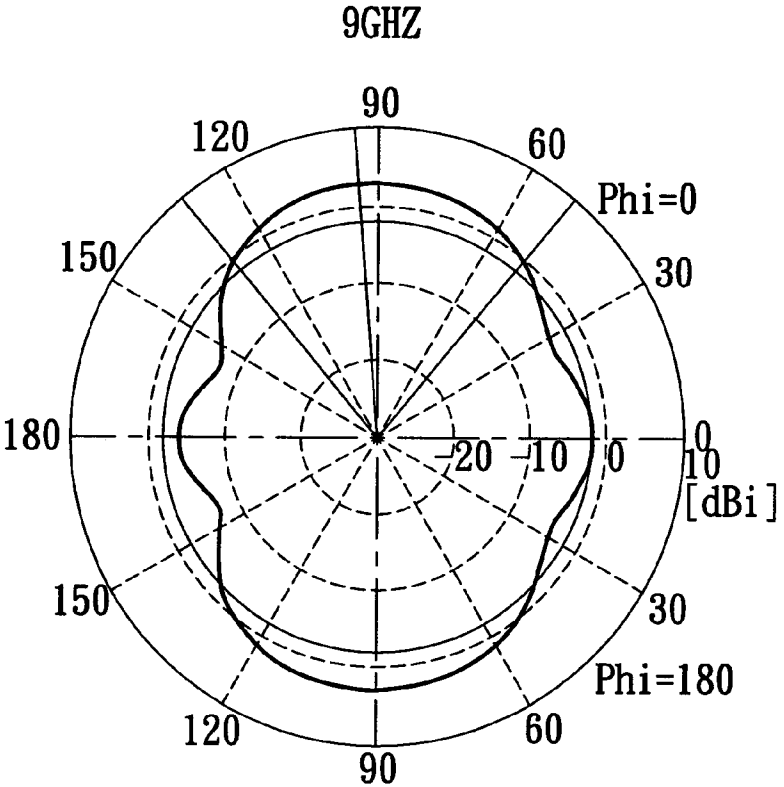
FIG. 2 PRIOR ART
FIG. 2 is a plot illustrating a radiation pattern of the conventional planar antenna in the x-y plane when operated at 9 GHz.
Figure 3:
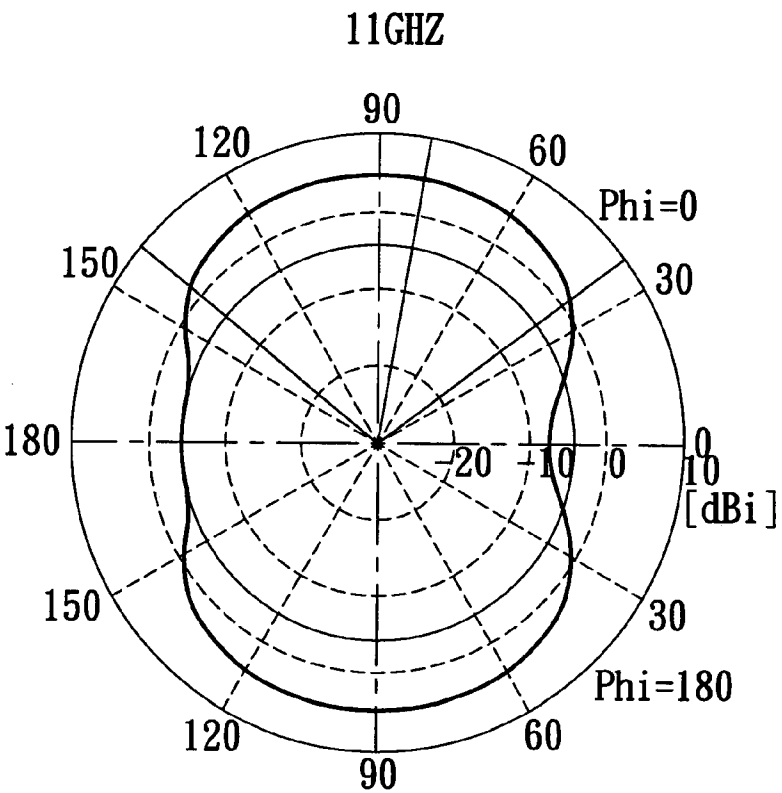
FIG. 3 PRIOR ART
FIG. 3 is a plot illustrating a radiation pattern of the conventional planar antenna in the x-y plane when operated at 11 GHz.

Before the present invention is described in greater detail, it should be noted that like elements are denoted by the same reference numerals throughout the disclosure.

Figure 4:
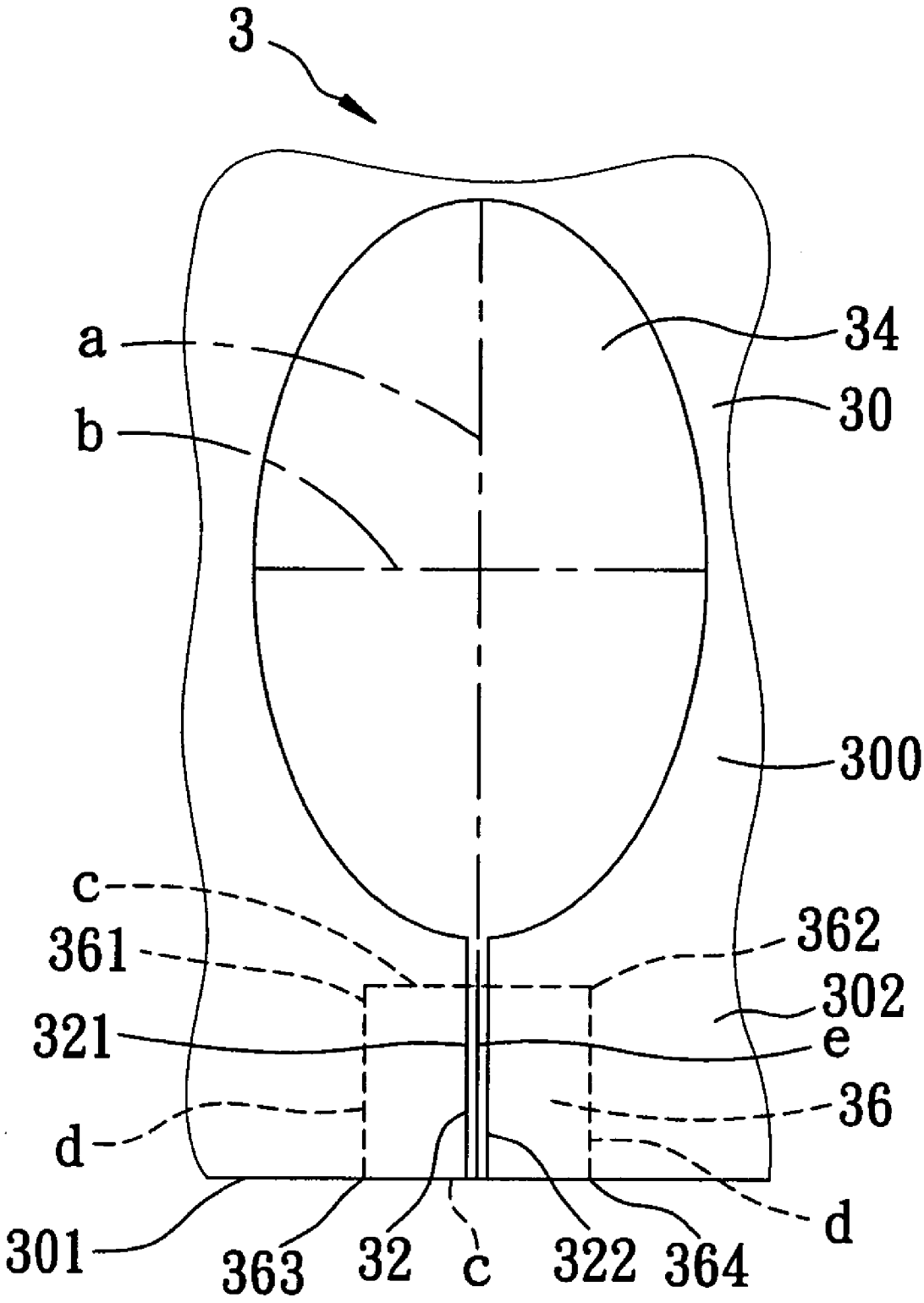
FIG. 4 is a schematic view of the first preferred embodiment of a planar antenna according to the present invention.
Figure 5:
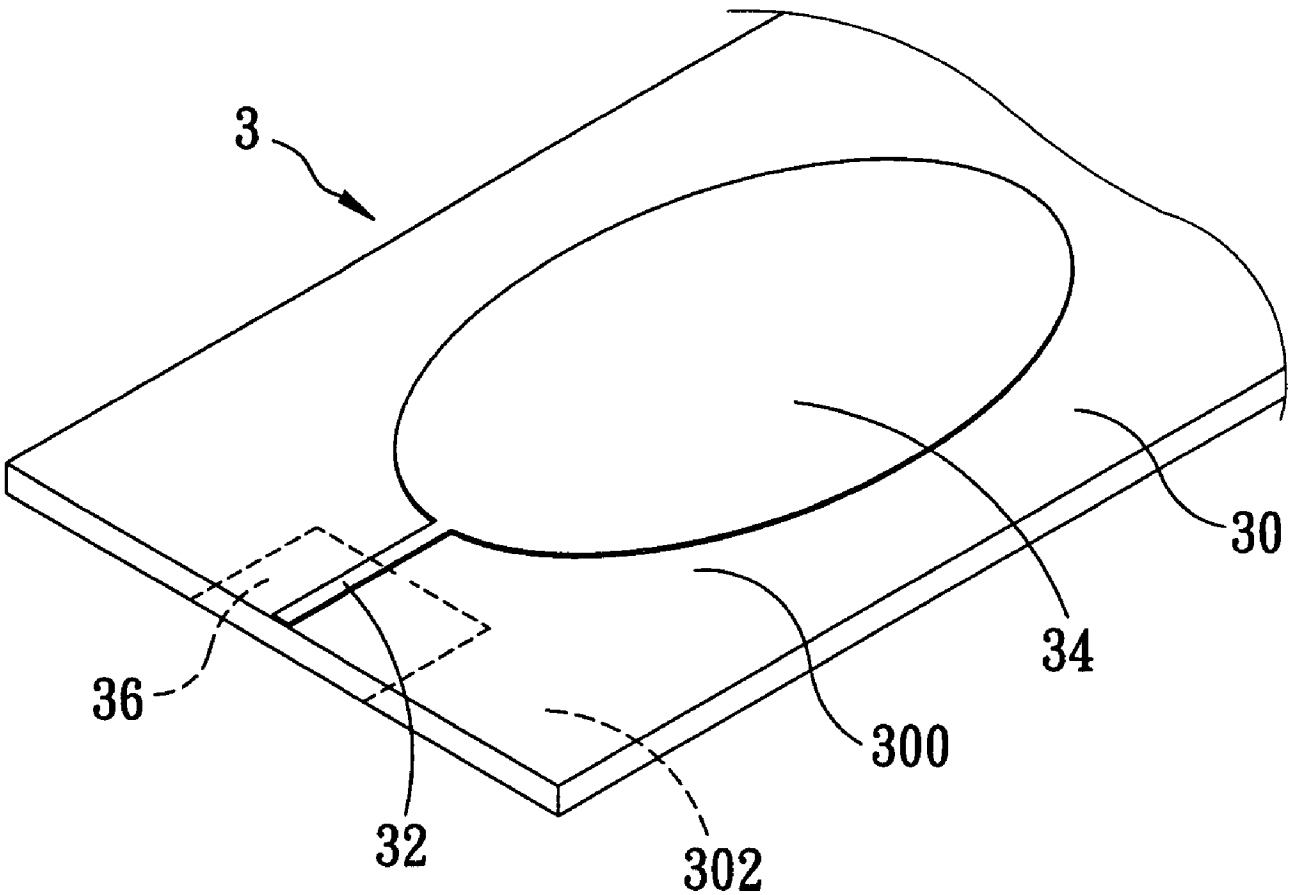
FIG. 5 is a fragmentary perspective view of the first preferred embodiment.

Referring to FIGS. 4 and 5, the first preferred embodiment of a planar antenna 3 according to this invention is shown to include a dielectric substrate 30, a radiating element 34, a feeding element 32, and a grounding element 36.

The planar antenna 3 of this embodiment is operable within the ultra wide band, i.e., between 3.1 GHz and 10.6 GHz.

The dielectric substrate 30 has opposite first and second surfaces 300, 302. In this embodiment, the dielectric substrate 30 is available from Rogers Corp. under model no. RO4003C. In an alternative embodiment, the dielectric substrate 30 is a FR-4 substrate.

The radiating element 34 is formed on the first surface 300 of the dielectric substrate 30, is generally elliptical in shape, and has minor and major axes (b, a). It is noted that the radiating element 34 is formed by providing first a copper foil on the first surface 300 of the dielectric substrate 30, and then by patterning and etching the copper foil. In this embodiment, the ratio of the major axis (a) to the minor axis (b) is 1.63. In an alternative embodiment, the ratio of the major axis (a) to the minor axis (b) is between 1.25 and 1.7.

The feeding element 32 is formed on the first surface 300 of the dielectric substrate 30, extends from the radiating element 34 along a line (e) that is collinear with the major axis (a) of the radiating element 34 and that passes through a midpoint of the feeding element 32, and has opposite first and second end portions 321, 322. The first end portion 321 of the feeding element 32 has a distal end that is distal from the second end portion 322 of the feeding element 32 and that is connected to an edge of the radiating element 34. The second end portion 322 of the feeding element 32 has a distal end that is distal from the first end portion 321 of the feeding element 32 and that is flush with an edge 301 of the dielectric substrate 30.

The grounding element 36 is formed on the second surface 302 of the dielectric substrate 30, and is coupled to the feeding element 32. In this embodiment, the grounding element 36 is generally rectangular in shape, and has a pair of long sides (c), each of which is parallel to and shorter than the minor axis (b) of the radiating element 34, and a pair of short sides (d). As illustrated in FIG. 4, the radiating element 34 and the grounding element 36 are not superimposed.

It is noted that the feeding element 32 is centered between projections of the short sides (d) of the grounding element 36 projecting in a direction perpendicular to the dielectric substrate 30. Moreover, the long side (c) of the grounding element 36, the one that is distal from the radiating element 34, is flush with the edge 301 of the dielectric substrate 30. Further, like the radiating element 34, the grounding element 36 is formed by providing a copper foil on the second surface 302 of the dielectric substrate 30, and then by patterning and etching the copper foil.

In this embodiment, the ratio of the long side (c) of the grounding element 36 to the minor axis (b) of the radiating element 34 is less than 0.5. Moreover, the ratio of the long side (c) to the short side (d) of the grounding element 36 is 1.06. Further, in an alternative embodiment, the ratio of the long side (c) to the short side (d) of the grounding element 36 maybe between 1.0 and 1.1.

Figure 6:
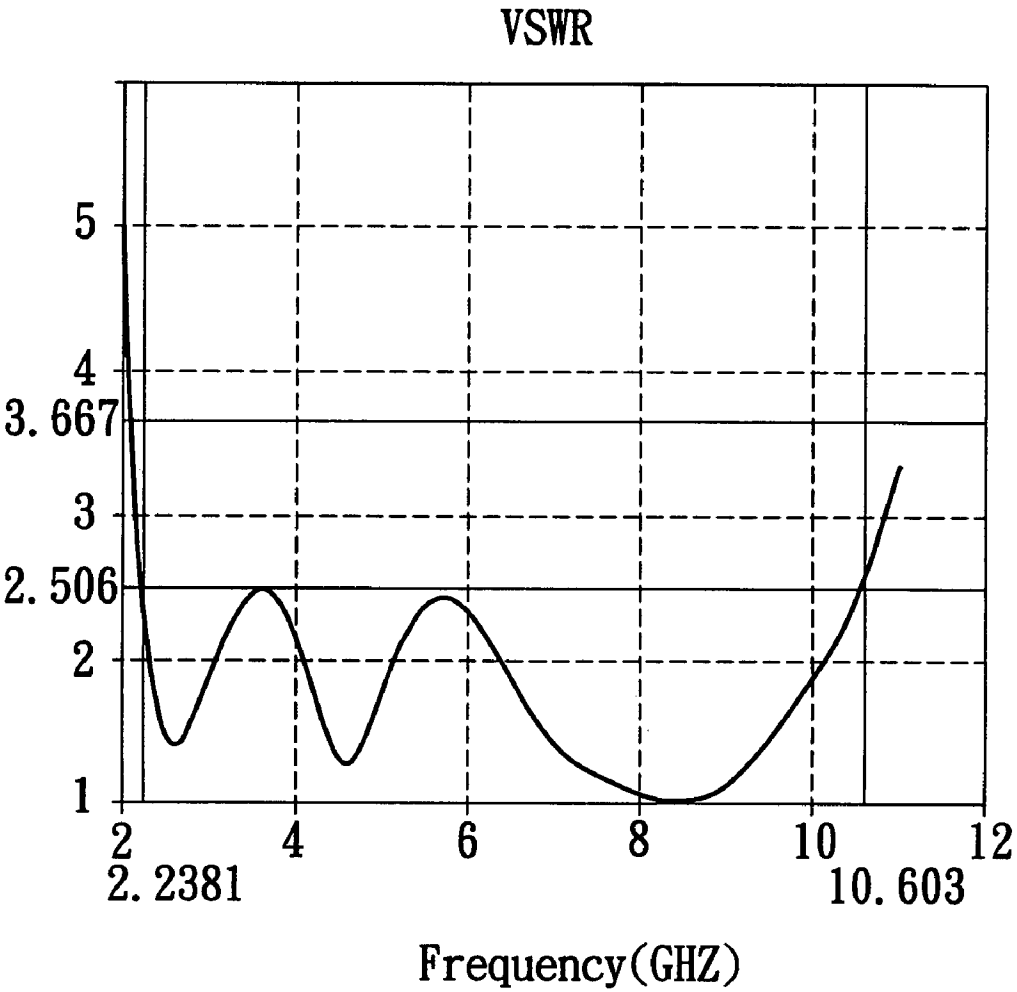
FIG. 6 is a plot illustrating a voltage standing wave ratio of the first preferred embodiment.
Figure 7:
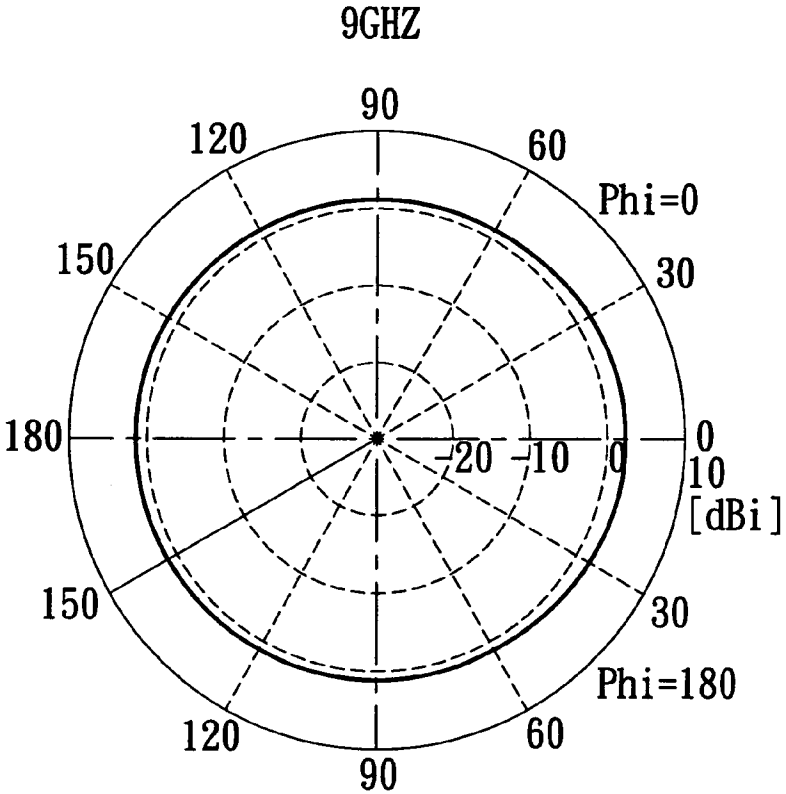
FIG. 7 is a plot illustrating a radiation pattern of the first preferred embodiment in the x-y plane when operated at 9 GHz.
Figure 8:
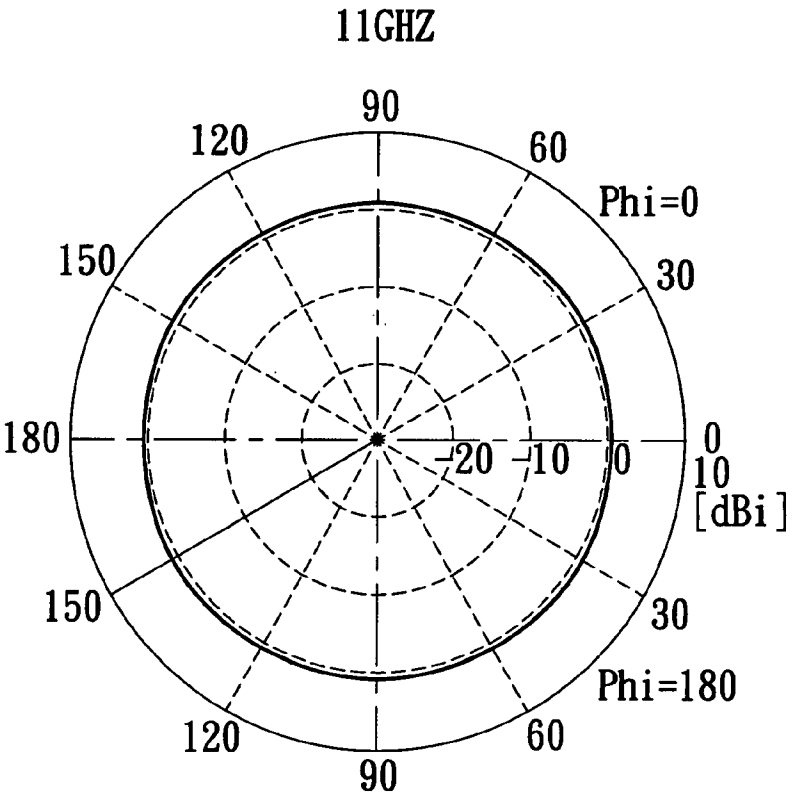
FIG. 8 is a plot illustrating a radiation pattern of the first preferred embodiment in the x-y plane when operated at 11 GHz.

Based on simulated results, as illustrated in FIG. 6, the planar antenna 3 of this invention achieves a voltage standing wave ratio (VSWR) of less than 2.5 when operated within 2.2381 GHz and 10.603 GHz. Moreover, as illustrated in FIG. 7, the planar antenna 3 of this invention has a radiation pattern that is substantially omni-directional when operated at 9 GHz. Moreover, as illustrated in FIG. 8, the planar antenna 3 of this invention has a radiation pattern that is also substantially omni-directional when operated at 11 GHz.

Figure 9:
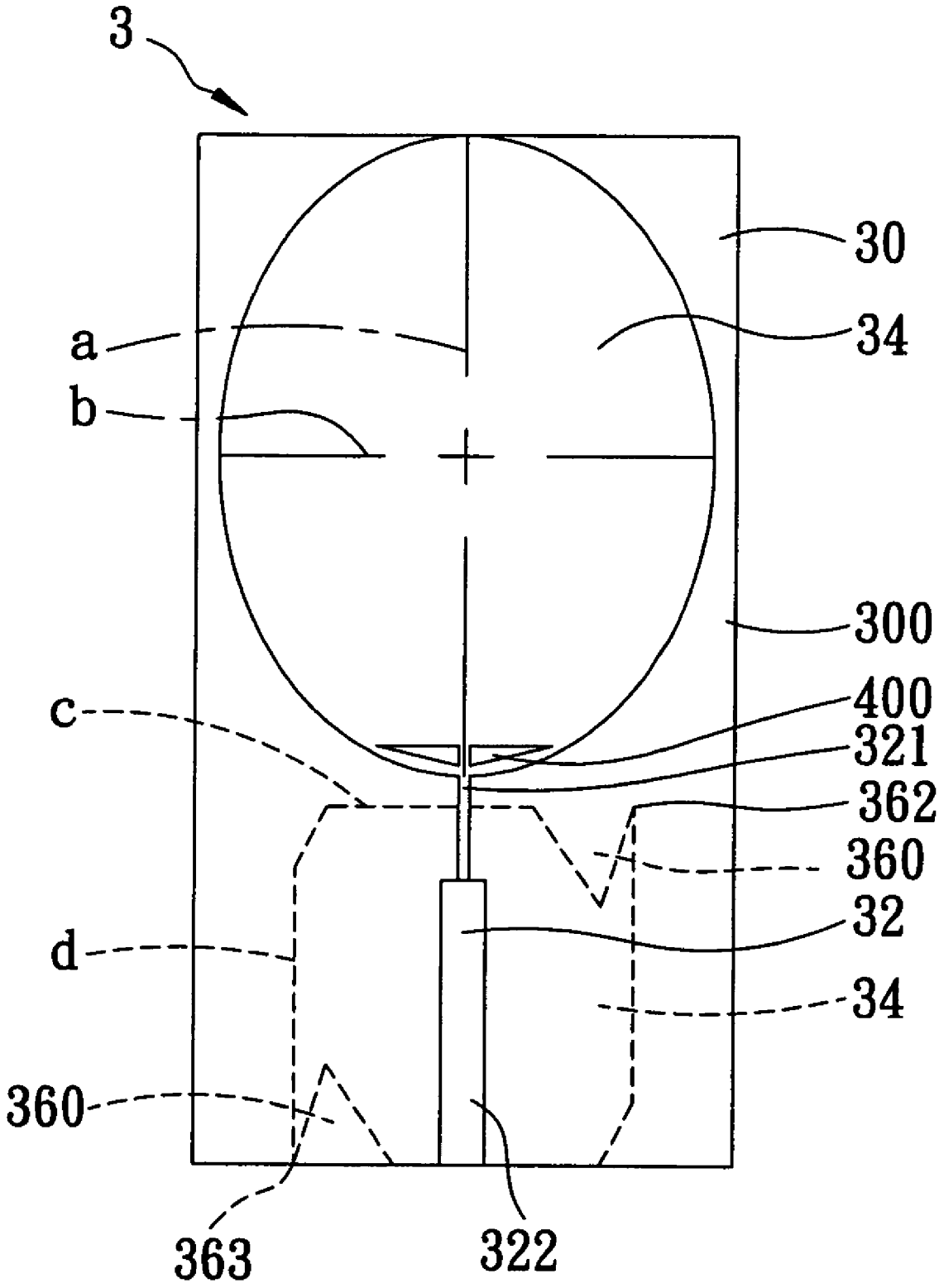
FIG. 9 is a schematic view of the second preferred embodiment of a planar antenna according to the present invention.

FIG. 9 illustrates the second preferred embodiment of a planar antenna 3 according to this invention. When compared with the previous embodiment, the first end portion 321 of the feeding element 32 has a width that is narrower than that of the second end portion 322 of the feeding element 32. Moreover, the radiating element 34 is formed with a pair of triangular holes 400 therethrough. Each of the holes 400 is defined by a hole-defining wall that has a side. The holes 400 are proximate to the feeding element 32, and are disposed on opposite sides of the major axis (a). In this embodiment, the holes 400 are symmetrical with respect to the major axis such that the sides of the hole-defining walls are parallel to the major axis (a). Further, the grounding element 36 has first and second corners 361, 362 (see FIG. 4) that are proximate to the radiating element 34, and third and fourth corners 363, 364 (see FIG. 4) that are distal from the radiating element 34. The grounding element 36 is formed with cutouts at the first and fourth corners 361, 364 thereof, and is formed with a pair of triangular grooves 360, each of which is disposed adjacent to a respective one of the second and third corners 362, 363 thereof.

It is noted that, unlike the previous embodiment, the ratio of the long side (c) of the grounding element 36 to the minor axis (b) of the radiating element 34 is not restricted to less than 0.50, and may be equal to or greater than 0.50. In addition, the ratio of the major axis (a) to the minor axis (b) is 1.375. In an alternative embodiment, the ratio of the major axis (a) to the minor axis (b) is 1.259.

Figure 10:
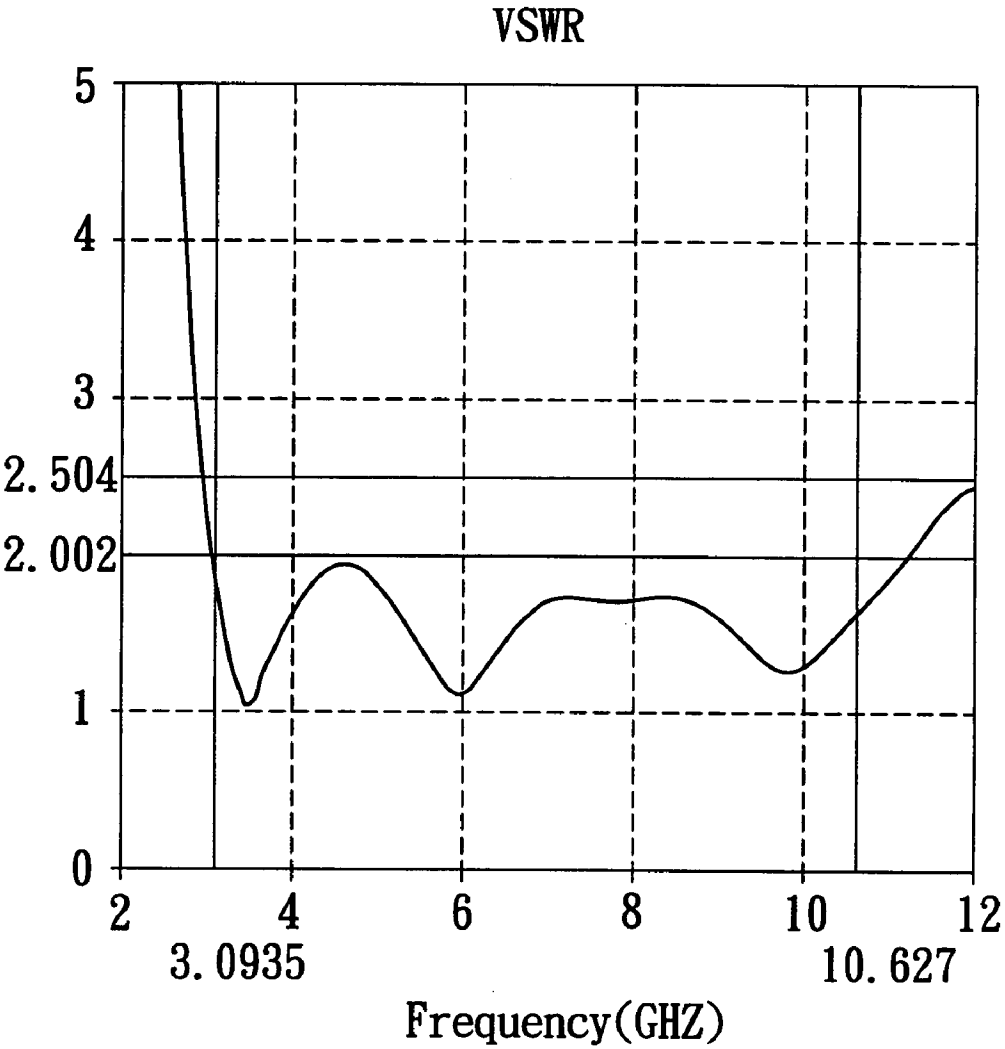
FIG. 10 is a plot illustrating a voltage standing wave ratio of the second preferred embodiment.
Figure 12:
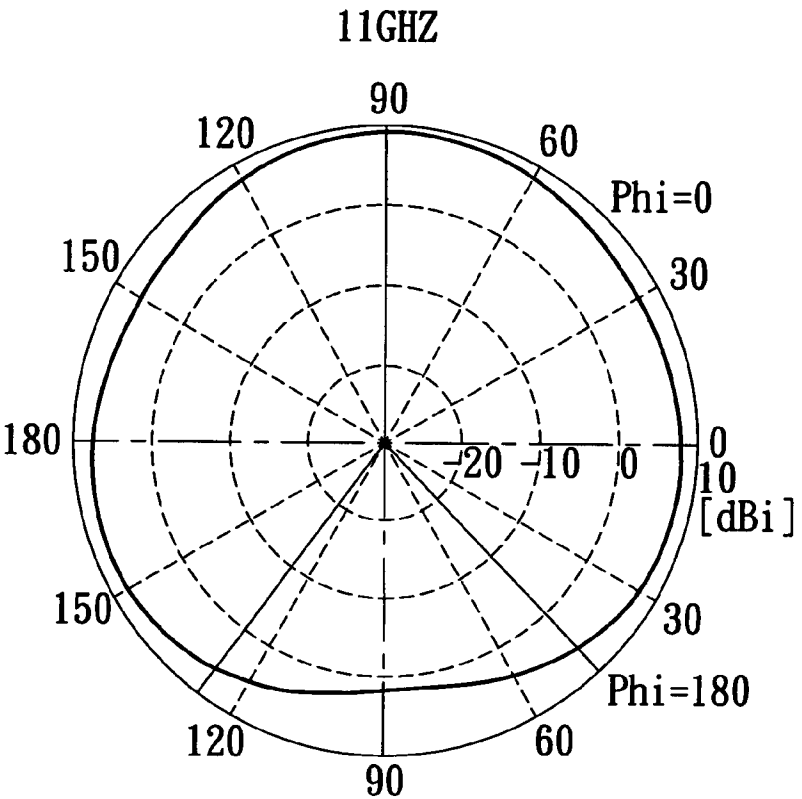
FIG. 12 is a plot illustrating a radiation pattern of the second preferred embodiment in the x-y plane when operated at 11 GHz.
Figure 11:
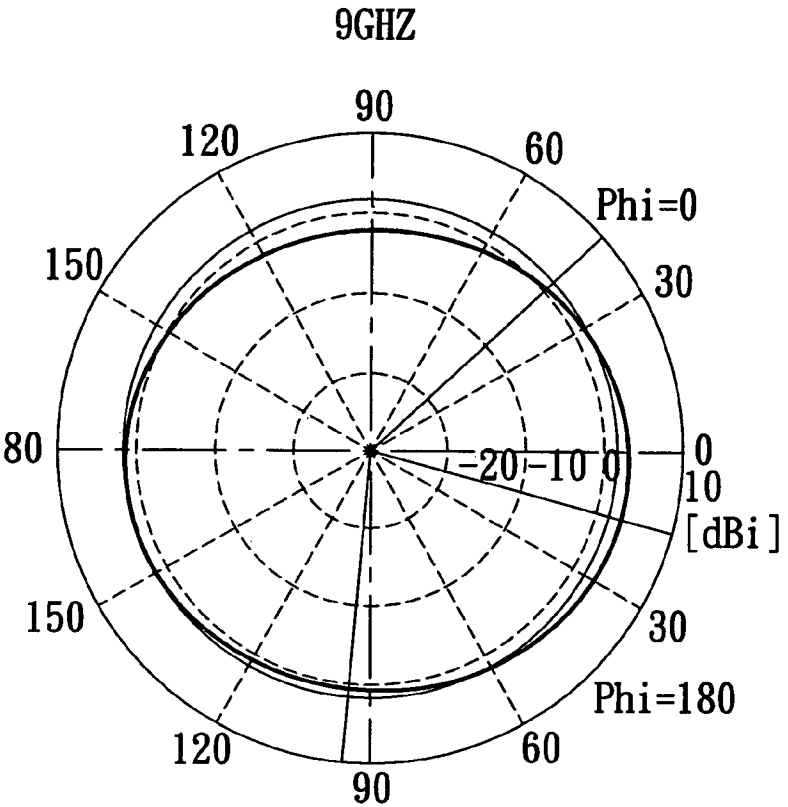
FIG. 11 is a plot illustrating a radiation pattern of the second preferred embodiment in the x-y plane when operated at 9 GHz.

Based on simulated results, as illustrated in FIG. 10, the planar antenna 3 of this invention achieves a voltage standing wave ratio (VSWR) of less than 2.002 when operated within 3.0935 GHz and 10.627 GHz. Moreover, as illustrated in FIG. 11, the radiation pattern of the planar antenna 3 of this invention in the X-Y plane is substantially omni-directional when operated at 9 GHz. Further, as illustrated in FIG. 12, the radiation pattern of the planar antenna 3 of this invention in the X-Y plane is also substantially omni-directional when operated at 11 GHz.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A planar antenna, comprising:

a dielectric substrate having opposite first and second surfaces;

an elliptical radiating element formed on said first surface of said dielectric substrate, having major and minor axes, and formed with a pair of three-sided holes therethrough, each of which is defined by a hole-defining wall that has a side;

a feeding element formed on said first surface of said dielectric substrate, coupled to said radiating element at one end of the major axis of said radiating element; and a grounding element formed on said second surface of said dielectric substrate, and coupled to said feeding element;

wherein said three-sided holes are disposed on opposite sides of the major axis of said radiating element, and wherein each said side of each said hole-defining wall is parallel to the major axis.

2. The planar antenna as claimed in claim 1, wherein said grounding element is generally rectangular, and has a short side, and a long side that is parallel to and shorter than the minor axis of said radiating element.

3. The planar antenna as claimed in claim 2, wherein said feeding element is centered between projections of said short sides of said grounding element projecting in a direction perpendicular to said dielectric substrate.

4. The planar antenna as claimed in claim 2, wherein the ratio of said long side to said short side of said grounding element is between 1.0 and 1.1.

5. The planar antenna as claimed in claim 2, wherein the ratio of said long side of said grounding element to the minor axis of said radiating element is less than 0.5.

6. The planar antenna as claimed in claim 1, wherein said feeding element has opposite first and second end portions, said first end portion being coupled to said radiating element, and having a width that is narrower than that of said second end portion of said feeding element.

7. The planar antenna as claimed in claim 1, wherein said radiating element is made from a copper material.

8. The planar antenna as claimed in claim 1, wherein said grounding element is made from a copper material.

9. The planar antenna as claimed in claim 1, wherein the ratio of the major axis of the radiating element to the minor axis of the radiating element is between 1.25 and 1.7.

10. The planar antenna as claimed in claim 1, wherein each of said three-sided holes is a triangular hole.

11. The planar antenna as claimed in claim 1, the planar antenna being operable in a range between 3.1 GHz and 10.6 GHz.

12. A planar antenna, comprising:

a dielectric substrate having opposite first surface and second surface;

an elliptical radiating element formed on said first surface of said dielectric substrate, and having major and minor axes;

a feeding element formed on said first surface of said dielectric substrate, and coupled to said radiating element at one end of the major axis of said radiating element; and a grounding element formed on said second surface of said dielectric substrate, coupled to said feeding element, and generally rectangular, said grounding element comprising:

a short side, a long side that is parallel to and shorter than the minor axis of said radiating element, first and second corners that are proximate to said radiating element, and third and fourth corners that are distal from said radiating element, said grounding element being formed with cutouts at said first and fourth corners thereof, and a pair of three-sided grooves, each of which is disposed adjacent to a respective one of said second and third corners of said grounding element.

13. The planar antenna as claimed in claim 12, wherein said feeding element extends from said radiating element along a line that is collinear with the major axis of said radiating element and that passes through a midpoint of said feeding element.

14. The planar antenna as claimed in claim 12, wherein said feeding element is centered between projections of said short sides of said grounding element projecting in a direction perpendicular to said dielectric substrate.

15. The planar antenna as claimed in claim 12, wherein the ratio of said long side to said short side of said grounding element is between 1.0 and 1.1.

16. The planar antenna as claimed in claim 12, wherein the ratio of said long side of said grounding element to the minor axis of said radiating element is less than 0.5.

17. The planar antenna as claimed in claim 12, wherein said feeding element has opposite first and second end portions, said first end portion being coupled to said radiating element, and having a width that is narrower than that of said second end portion of said feeding element.

18. The planar antenna as claimed in claim 12, wherein at least one of said grounding element and said radiating element is made from a copper material.

19. The planar antenna as claimed in claim 12, wherein the ratio of the major axis of the radiating element to the minor axis of the radiating element is between 1.25 and 1.7.

20. The planar antenna as claimed in claim 12, wherein each of said three-sided grooves is a triangular groove.

21. The planar antenna as claimed in claim 12 the planar antenna being operable in a range between 3.1 GHz and 10.6 GHz.

* * * * *